United States Patent [19]

Nagashima et al.

[11] Patent Number: 4,830,525

[45] Date of Patent: May 16, 1989

[54] TYPEWRITER WITH PIVOTING KEYBOARD

[75] Inventors: Yoshimitsu Nagashima; Yojiro Fukui; Yoshimi Takahashi, all of Kodaira, Japan

[73] Assignee: Silver Seiko Ltd., Kodaira, Japan

[21] Appl. No.: 156,751

[22] Filed: Feb. 18, 1988

[30] Foreign Application Priority Data

Mar. 5, 1987 [JP] Japan ..... 62-31064[U]

[51] Int. Cl.[4] ..... B41J 5/10

[52] U.S. Cl. ..... 400/472; 400/682; 400/691

[58] Field of Search ..... 400/680–685, 400/691–693, 472

[56] References Cited

U.S. PATENT DOCUMENTS 3,990,565 11/1976 Felton et al. ..... 400/682 X
4,509,873 4/1985 Ryan ..... 400/489

FOREIGN PATENT DOCUMENTS 0066988 4/1982 Japan ..... 400/691
0166088 10/1983 Japan ..... 400/693.1
0094377 5/1985 Japan ..... 400/693
2177246 1/1987 United Kingdom ..... 400/693.1

OTHER PUBLICATIONS

"Access Method for Feature Expansion", IBM Technical Disclosure Bulletin, vol. 29, No. 8, Jan. 1987, p. 3491.

Wang, J. P., "Cartridge Cover for a Typewriter", IBM Technical Disclosure Bulletin, vol. 24, No. 1B, Jun. 1981, p. 578.

*Primary Examiner*—Edgar S. Burr
*Assistant Examiner*—James Lisehora
*Attorney, Agent, or Firm*—Cushman, Darby & Cushman

[57] ABSTRACT

A typewriter which has a minimized dimension in the direction of the depth and requires a minimized overall installation area. The typewriter includes a keyboard mounted at a portion near a top, front side of the typewriter housing and is pivotable from and to a horizontal position. When pivoted in a normally closed position, it lies substantially in a plane of a top opening formed in the typewriter housing. The keyboard is located such that its rear end is positioned very close to a platen mounted at a rear portion of the typewriter housing and covers the area of movement of a ribbon cassette carried on a carrier that is mounted to the typewriter housing and moves parallel to the platen.

5 Claims, 2 Drawing Sheets

TYPEWRITER WITH PIVOTING KEYBOARD

BACKGROUND OF THE INVENTION

1. Field of the Invention

This invention relates to a typewriter of the type wherein a carrier carrying a printing device and a ribbon cassette is moved in a direction parallel to a platen in order to print on paper disposed in the platen.

2. Description of the Prior Art

In a conventional typewriter, a keyboard is fixedly mounted on a typewriter body in a predetermined spaced relationship from the platen to provide a spacing that allows a carrier to move. The spacing is normally covered by a removable top cover so that foreign particles such as dust are not readily introduced into a typewriter mechanism within a typewriter body.

Such spacing as described above normally involves a considerable horizontal area and a considerable dimension in the direction of the depth of the typewriter. Accordingly, the typewriter must be designed with a size taking the horizontal area and the dimension in the direction of the depth of the spacing into consideration.

However, a typewriter without such a spacing between the platen and keyboard will have a reduced dimension in the depth direction and require a reduced installation area. Such reduction in size would require reduction in size at least of a frame and a housing or casing and will facilitate transportation and storage of the typewriter. Besides, a top cover for covering over the spacing may then be eliminated.

SUMMARY OF THE INVENTION

Accordingly, it is an object of the present invention to provide a typewriter which has a minimized dimension in the depth direction and requires a minimized overall installation area.

In order to attain this object, according to the present invention, there is provided a typewriter which comprises a typewriter body or having a substantially rectangular top opening formed therein. A platen is mounted at a rear part of the top opening in the typewriter body for removably carrying and feeding print paper. A carrier mounted in the typewriter body moves parallel to the platen and is adapted to carry a removable ribbon cassette. The carrier also has attached to it means for printing characters on the print paper carried on the platen. A keyboard has a substantially rectangular shape and is pivotally supported at a side portion for pivotal motion around an axis extending near and substantially in parallel to a side of the top opening of the typewriter body. Means for supporting a lower face of the keyboard to define a normally closed position of the keyboard in which the keyboard lies substantially in the same plane with the top opening can also exist. When the keyboard is in the normally closed position, it covers the entire area of movement of a ribbon cassette carried on the carrier.

With the typewriter of the present invention, since the keyboard is located near the platen and the spacing for allowing movement of the carrier is not provided between the keyboard and the platen, the overall width of the typewriter in the depth direction can be reduced, reduction in size can occur, and the installation area of the typewriter on a desk can be reduced. The typewriter is also convenient for transportation and accommodation. Further, by pivoting the keyboard upwardly, the location above a substantial area of movement of the carrier can be opened. Accordingly, the keyboard serves also as a top cover for covering over such an area of the typewriter, which eliminates the need for an additional top cover.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
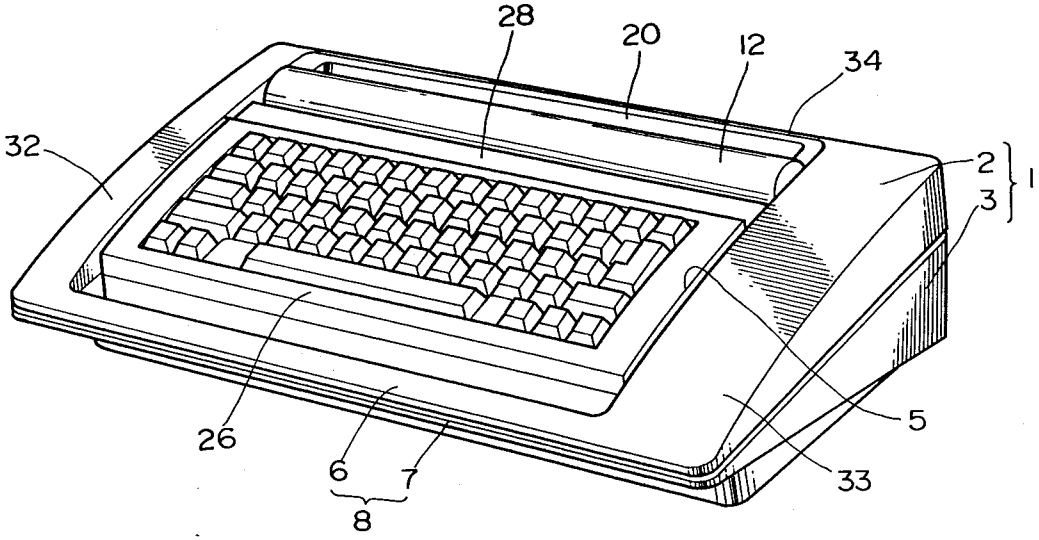
FIG. 1 is a perspective view of a typewriter showing a preferred embodiment of the present invention.
Figure 2:
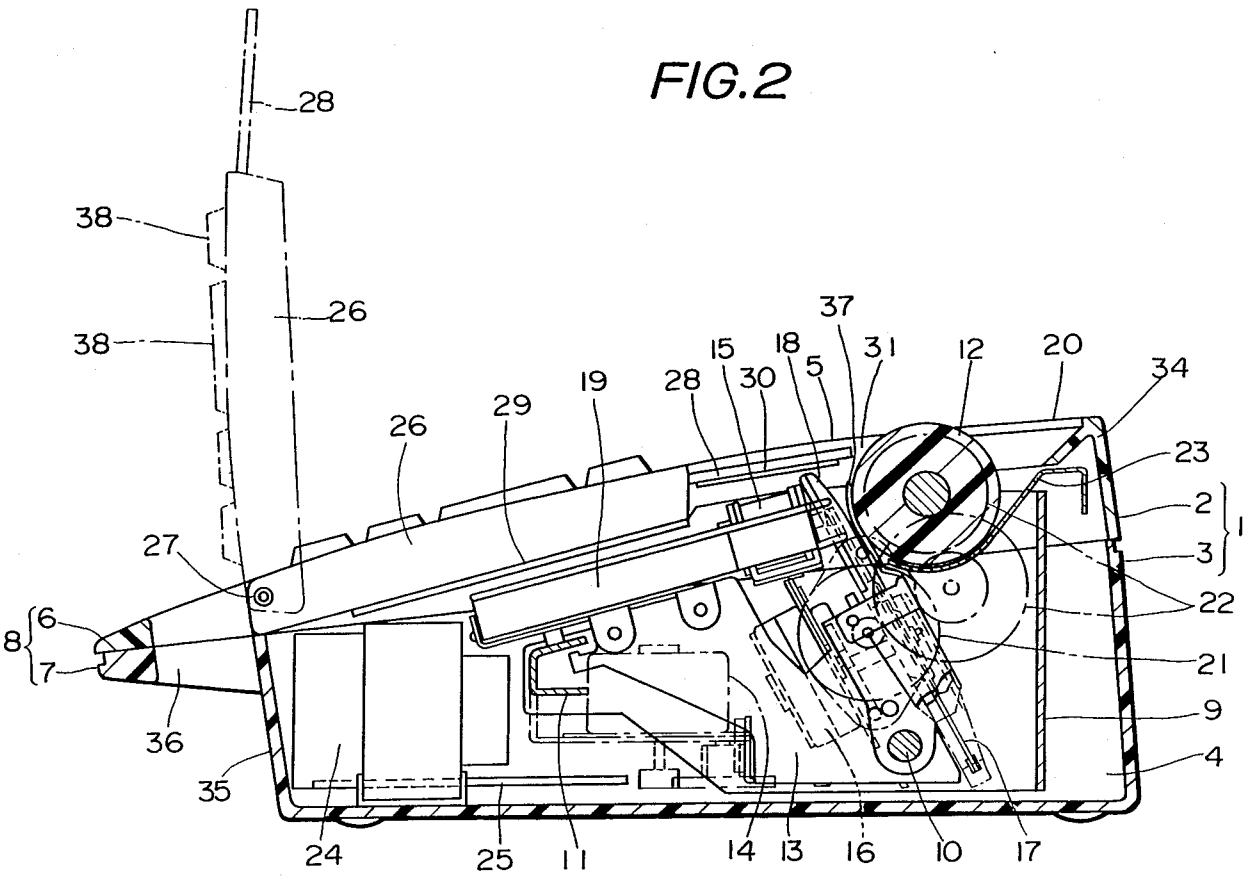
FIG. 2 is a vertical sectional view of the typewriter of FIG. 1.

Referring first to FIG. 1, the typewriter shown includes an upper casing 2 and a lower casing 3 which are joined together to form a typewriter body (also termed housing) 1 in which an accommodating spacing 4 is defined as shown in FIG. 2. Referring also to FIG. 2, the upper casing 2 has a top rectangular opening 5 formed therein. The top opening 5 presents a substantially rectangular shape in plan and is contiguous to the accommodating spacing 4 of the typewriter body 1. The upper casing 2 is thus formed as a substantially rectangular frame having left and right side portions 32 and 33 and front and rear side portions 6 and 34. The front side portion 6 of the upper casing 2 serves as part of a handle 8 for facilitating manipulation of the typewriter. Meanwhile, the lower casing 3 has formed on a front wall 35 thereof a handle part 7 which is similar in configuration and is joined to the handle part 6 of the upper casing 2 to form the handle 8. The handle 8 is spaced from the front wall 35 of the lower casing 3 so as to define therebetween a spacing 36 for allowing a hand of an operator to pass therethrough and grasp the handle 8.

A frame 9 is securely mounted in the accommodating spacing 4 on the lower casing 3, and a platen 12 is mounted for rotation on the frame 9. A carrier guide shaft 10 and a carrier guide rail 11 are securely mounted on the frame 9 in a parallel relationship to the platen 12, and a carrier 13 is supported for sliding movement in leftward and rightward directions on the carrier guide shaft 10 and the carrier guide rail 11. The carrier 13 is connected to a carrier feed motor 14 so that it may be fed in a direction parallel to the platen 12 in a known manner.

A print hammer 15 and a type selecting motor 16 are carried on the carrier 13, and a wheel cassette 18 in which a type element 17 in the form of a well-known daisy wheel type wheel is accommodated for rotation is removably mounted the carrier 13 such that it may be driven to rotate by the type selecting motor 16. One of character types not shown on the type element 17 which is stopped at a printing position is struck by the print hammer 15 against paper not shown carried on the platen 12 via a print ribbon not shown interposed between the type element 17 and the platen 12 in order to print a character of the character type on the paper as well known in the art. Such a print ribbon is fed from and back into a ribbon cassette 19 which is removably carried on the carrier 13.

The platen 12 is located at an upper part of the accommodating spacing 4 of the typewriter body 1 and partly extends through the top opening 5 of and upwardly above the upper casing 2 with a paper inserting entrance 20 left between the platen 12 and the rear side portion 34 of the upper casing 2. The platen 12 is connected to be rotated by a line feed motor 21 by way of a speed reduction gear 22. A paper guide plate 23 is located below the platen 12, and another paper guide plate 37 is mounted on the carrier 13 forwardly of the platen 12. The paper guide plates 23 and 37 cooperate with the platen 12 to define a paper path along which paper not shown inserted from the paper inserting entrance 20 is fed.

A circuit board 25 having an electric control circuit for the typewriter thereon and a transformer 24 for feeding the control circuit and other electric elements not shown of the typewriter are also securely mounted in the accommodating spacing 4 on the lower casing 3 by suitable means not shown.

A keyboard 26 is located in the top opening 5 of the upper casing 2. In particular, the keyboard 26 is not securely mounted on the typewriter body 1 as in a conventional typewriter but is supported at a portion near a side thereof for pivotal motion around an axis extending near and substantially in parallel to a side of the top opening 5 of the typewriter body 1. More particularly, a pair of pivot shafts 27 are securely mounted in a line at locations of the left and right side portions 32 and 33 of the upper casing 2 a little above the front wall 35 of the lower casing 3 and are received in corresponding holes not shown formed at locations near forward ends of opposite left and right side walls of the keyboard 26. It is to be noted that the pivot shafts 27 may be replaced by a single shaft which extends through the keyboard 26 between the left and right side portions 32 and 33 of the upper casing 2. Thus, the keyboard 26 can be pivoted around the axis provided by the pivot shafts 27 to move a rear end portion thereof upwardly and downwardly toward and away from the ribbon cassette 19 on the carrier 13 in the typewriter body 1. The keyboard 26 may be stopped at any intermediate pivoted position between a horizontal solid line position and a substantially vertical chain line position shown in FIG. 2 by suitable known means not shown. A transparent or translucent scale plate 28 is secured to a rear end of the keyboard 26 and extends rearwardly in a substantially same plane with the keyboard 26.

A pair of inwardly extending keyboard seat plates 29 and another pair of inwardly extending scale plate seat plates 30 are formed in an integral relationship on inner sides of the left and right side portions 32 and 33 of the upper casing 2 for engaging with lower faces of left and right end portions of the keyboard 26 and the scale plate 28, respectively. Thus, if the keyboard 26 is pivoted rearwardly and downwardly until the keyboard 26 and the scale plate 28 are stopped by the seat plates 29 and 30, respectively, they are supported at their normal positions for use by the seat plates 29 and 30, respectively, in which they lie substantially in the same plane with the top opening 5 of the upper casing 2 as seen in FIG. 2. In this condition, keys 38 of the keyboard 26 will be operated to print corresponding characters on paper inserted from the paper inserting opening 20 and fed along the paper path around the platen 12. Here, since the handle 8 is located a little forwardly of the keyboard 26, it can be utilized as a hand supporting base.

As particularly seen from FIG. 2, the keyboard 26 in the normal position covers over an entire area of movement of a ribbon cassette 19 carried on the carrier 13 and closes a substantially front half of the top opening 5 of the upper casing 2 while the scale plate 28 is positioned above a rear part of the ribbon cassette 19 and a printing means including the type element 17 and the print hammer 28 carried on the carrier 13 and closes substantial part of an intermediate area of the upper opening 5, that is, the remaining part of the upper opening 5 which is defined between a rear end of the keyboard 26 and the platen 12 with a paper discharging gap 31 left between a rear end edge of the scale plate 28 and the platen 12 for allowing paper fed along the paper path to be discharged from the typewriter therethrough.

It is to be noted here that while in the embodiment shown the area of substantial part of the carrier 13, that is, the portion of the carrier 13 forward of the platen 12 that is almost all occupied by the ribbon cassette 19 carried on the carrier 13, is covered by a keyboard unit including the keyboard 26 and the scale plate 28 mounted on the keyboard 26, that the keyboard 26 itself may have a sufficient rearward dimension to cover over the area described above. Anyway, the dimension of the typewriter in the direction of the depth can be reduced by the extent over which the keyboard 26 itself or a rearward extension of the keyboard 26 such as the scale plate 28 covers over the area of movement of the carrier 13 as compared to that of a conventional typewriter arrangement.

Meanwhile, if the keyboard 26 is erected uprightly as shown in chain lines in FIG. 2, a portion of the top opening 5 fowardly of the platen 12 is opened at once. Accordingly, the ribbon cassette 19 and/or the daisy wheel 17 can be changed readily, and the typewriter mechanism within the body 1 can be inspected readily through the top opening 5 of the upper casing 2.

It is to be noted that, though not shown, a switch is provided for each the individual keys 38 of the keyboard 26 and develops an electric signal when the corresponding key 38 is operated. Such an electric signal is transmitted to the control circuit on the circuit board 25 by way of a flexible flat cable not shown connected between the keyboard 26 and circuit board 25. The flat cable will not interfere with pivotal motion of the keyboard 26.

Having now fully described the invention, it will be apparent to one of ordinary skill in the art that many changes and modifications can be made thereto without departing from the spirit and scope of the invention as set forth herein. For example, while in the embodiment shown the keyboard 26 is supported for pivotal motion around a horizontal axis near the forward edge thereof, it may otherwise be supported for pivotal motion around a perpendicular horizontal axis near the left or right end edge thereof so as to allow the keyboard 26 to be pivoted open rightwardly or leftwardly, or else it may be supported for pivotal motion around a horizontal axis at the handle 8.

What is claimed is:

1. A typewriter having minimal depth dimensions for printing characters on paper comprising:

a substantially rectangular housing having a substantially rectangular opening located on a top side of said housing and extending from a rear side toward a front side of said housing and from a left side to a right side of said housing;

a platen mounted at a rear part of said rectangular opening that is parallel to and in close proximity to said rear side of said housing for carrying and feeding said paper;

a carrier mounted in said rectangular housing capable of moving parallel to said platen and adapted to carry a removable ribbon cassette;

means attached to said carrier and disposed between said carrier and said platen for printing characters on paper disposed in said platen;

a substantially rectangular keyboard disposed in a front part of said rectangular opening, said keyboard pivotable around an axis extending near and substantially in parallel to one of said sides of said rectangular opening from a normally closed positions to an open position so that when in said normally closed position said keyboard is located substantially in a plane containing said top side of said housing and an area of movement of said removable ribbon cassette is disposed below said keyboard; and means for supporting a lower face of said keyboard when said keyboard is located substantially in said plane containing said top side of said housing.

2. A typewriter as claimed in claim 1, wherein said axis of pivotal motion of said keyboard extends near and substantially in parallel to a front side of said rectangular opening of said housing.

3. A typewriter as claimed in claim 1, wherein said axis of pivotal motion of said keyboard extends near and substantially in parallel to a left side or right side of said rectangular opening of said housing.

4. A typewriter as claimed in claim 1, wherein a rear end of said keyboard has a scale plate that covers a rear portion of said ribbon cassette.

5. A typewriter as claimed in claim 1, wherein a rear side of said keyboard, when in said normally closed position, is spaced from said platen to define therebetween a gap through which paper fed by said platen is discharged from said typewriter.

* * * * *